US006474400B1

(12) United States Patent
Kaneto et al.

(10) Patent No.: US 6,474,400 B1
(45) Date of Patent: Nov. 5, 2002

(54) MOLDING EQUIPMENT FOR FRAMED SAND MOLDS

(75) Inventors: Kimikazu Kaneto, Toyokawa (JP); Minoru Hirata, Toyokawa (JP); Yutaka Hadano, Toyokawa (JP)

(73) Assignee: Sintokogio, Ltd., Aichi-ken (JP)

( * ) Notice: Subject to any disclaimer, the term of this patent is extended or adjusted under 35 U.S.C. 154(b) by 0 days.

(21) Appl. No.: 09/979,723

(22) PCT Filed: Mar. 26, 2001

(86) PCT No.: PCT/JP01/02391

§ 371 (c)(1),
(2), (4) Date: Nov. 28, 2001

(87) PCT Pub. No.: WO01/74516

PCT Pub. Date: Oct. 11, 2001

(30) Foreign Application Priority Data

Mar. 31, 2000 (JP) ..... 2000-96772

(51) Int. Cl.[7] ..... B22C 9/20; B22C 15/02

(52) U.S. Cl. ..... 164/323; 164/195; 164/201; 164/207

(58) Field of Search ..... 164/323, 195, 164/201, 207, 37, 38

(56) References Cited

U.S. PATENT DOCUMENTS 5,794,681 A * 8/1998 Oda et al. ..... 164/195

FOREIGN PATENT DOCUMENTS

GB 2044648 * 10/1980
JP 53/54124 5/1978

* cited by examiner

*Primary Examiner*—Tom Dunn
*Assistant Examiner*—I.-H. Lin
(74) *Attorney, Agent, or Firm*—Finnegan, Henderson, Farabow, Garrett & Dunner LLP

(57) ABSTRACT

A molding system to make a sand mold with a frame is provided to receive the lateral loads generated when molding frames are fed out and in by nearby apparatuses and to prevent vibrations generated during a molding operation from being transmitted to nearby apparatuses, so that the area around a factory is prevented from being degraded and so that apparatuses can be easily affixed. The molding system includes a molding support located on a plurality of vibration-insulating pads, a turntable to allow pattern carriers to be alternately fed in and out above the molding support, a molding head that is located above the turntable and that moves up and down, two pairs of centering pins located on the molding head, roller frames for feeding in and out molding frames from which hang rollers located outside of and near the highest end of the molding head, centering bushes, located above the roller frames for feeding molding frames in and out, that correspond to the two pairs of the centering pins, and a roller hung from the molding head.

6 Claims, 4 Drawing Sheets

MOLDING EQUIPMENT FOR FRAMED SAND MOLDS

FIELD OF INVENTION

This invention relates to a molding system for alternately making upper and lower sand molds in empty molding frames to be fed in a molding apparatus.

PRIOR ART

Conventional molding systems for sand moldings with frames have had their strength increased by having connected a molding apparatus to both a base and related apparatuses near it to counter the large lateral load generated when the molding frames are fed in and out, or when pattern carriers for upper and lower molding frames are exchanged.

However, the above molding systems have a disadvantage wherein it is difficult to insulate vibrations that are generated during molding operations from the molding system, so that the environment of a factory is damaged.

Also, there is another disadvantage, wherein it takes a long time to fix those apparatuses at the factory, and the cost for doing so is increases, because accurate centering operations are needed for those apparatuses to prevent them from not working after they are fixed.

This invention was conceived to overcome those disadvantages. The object of this invention is to provide a molding system for making a sand mold with a frame. By the invention the lateral load generated when the molding frames are fed in and out or pattern carriers for upper and lower molding frames are exchanged can be insulated from the apparatuses near the molding apparatus, and by which the vibrations generated during molding operations can be prevented from being transmitted to those nearby apparatuses, so that the environment of a factory can be prevented from being degraded, and so that the apparatuses can be easily fixed at the factory.

SUMMARY OF INVENTION

This invention is to achieve the above object. The molding system for a sand molding with a frame of this invention is characterized by a molding support that is held on a plurality of vibration-isolating pads, a turntable that can alternately feed in and out carriers for patterns above the molding support, a molding head held by a pair of frame-setting cylinders to move up and down above the turntable, two pairs of centering pins projecting upward at the sides of the lower end of the molding head, roller frames positioned near the lower end of the molding head at both its sides and hanging molding frames to feed them in and out, centering bushes put on the upper parts of the roller frames in line with the two pairs of the centering pins, and rollers hanging from the molding head.

PREFERRED EMBODIMENTS

Figure 1:
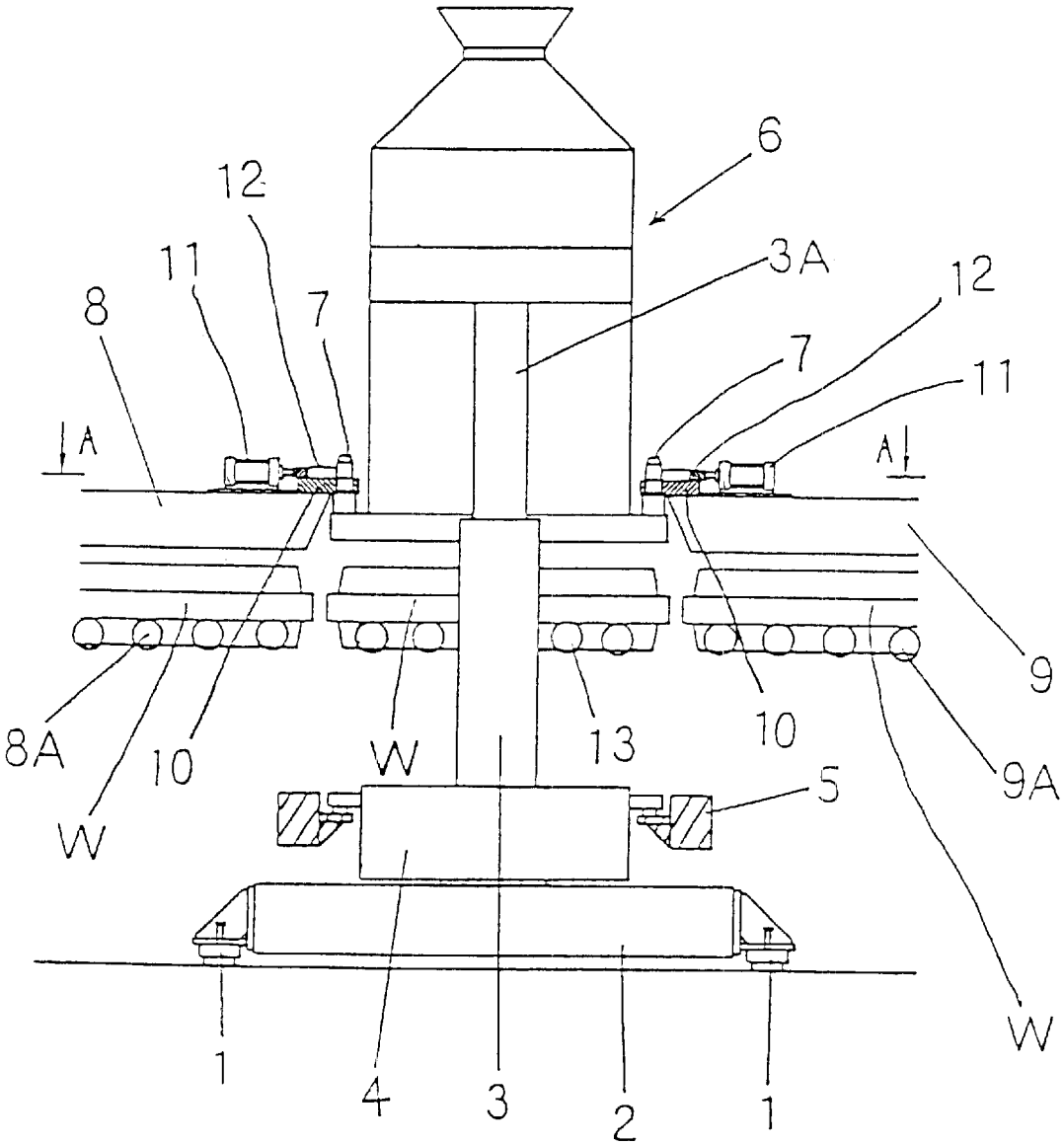
FIG. 1 is a schematic front view of the molding system before the molding operation starts. Part of the system is omitted.

Based on the drawings we below explain one embodiment of this invention. As in FIGS. 1 and 3, a molding support 2 is fixed on a plurality of vibration-insulating pads 1, 1 on a base. As in FIG. 4, which is a sectional view along the line B—B in FIG. 3, a pair of vertical frame-setting cylinders 3, 3 are located on the front and rear ends of the molding support 2. The frame-setting cylinder 3 at the front side (at the lower side in FIG. 4) is also used for the shaft rotating in the. center of a turntable 5, on which two pattern carriers 4, 4 are put.

Again as in FIG. 1, a molding head 6 is held on the upper ends of piston rods 3A, 3A of the pair of the frame-setting cylinders 3, 3. Two pairs of centering pins 7, 7 are located at the sides of the lower end of the molding head 6. They project upward. These pins function as a first centering means.

Roller frames 8, 9, which support rollers 8A, 9A that feed in and out molding frames W, are fixed near the sides of the molding head 6 to maintain a space between the roller frames 8, 9 so that the molding head can move up and down through the space.

Figure 2:
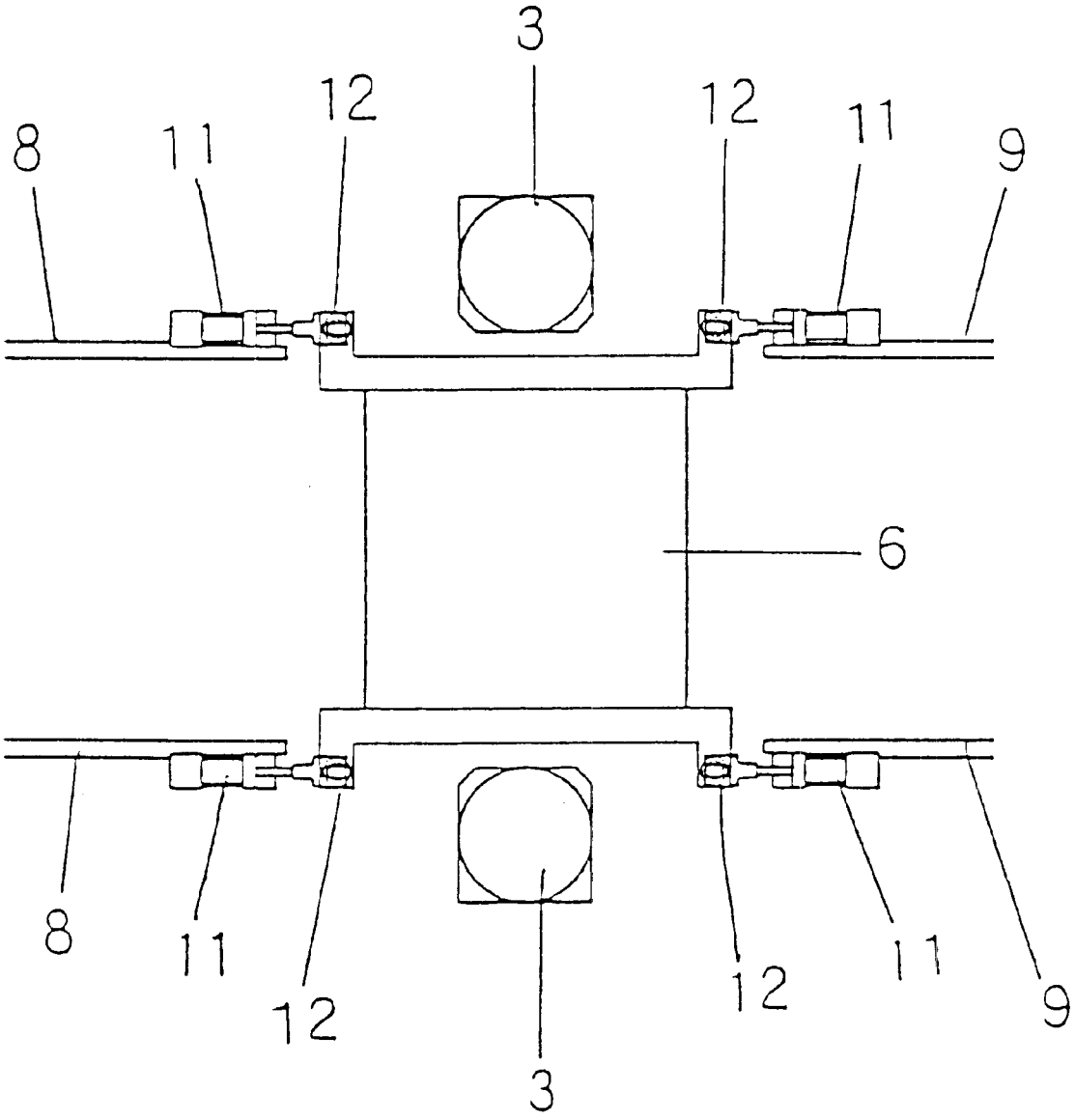
FIG. 2 is a sectional view along the line A—A in FIG. 1.

Centering bushes 10, 10 are located on the upper parts of the roller frames 8, 9, which are used to feed the molding frames in and out. The bushes project opposite each other, and are located opposite the two pair of centering pins 7, 7 such that the bushes correspond to the two pair of centering pins 7, 7, which receive them. The bushes function as a second centering means. Safety stoppers 12, 12 are located above the centering bushes 10, 10 (see FIGS. 1, 2, and 3). The stoppers 12, 12 engage with or disengage from the centering pins 7, 7 by means of the cylinders 11,11.

Rollers 13 are hung from a roller frame (not shown) that is located on the molding head 6. Also, the roller frame is located between the rollers 8A, 9A After an empty molding frame W is fed in by the roller 8A, as the molding head 6 moves down the molding frame W also moves down. Then, the molding frame W is set on one of the pattern carriers 4, 4 (FIG. 3), which carriers are put on the turntable 5.

The molding frame is set as described above. As shown in FIG. 1, each molding frame W is transferred rightward by given distances, and then an empty molding frame W is put below the molding head 6. The lateral load that is generated during that time is received by the roller frames 8, 9 through both the centering pins 7, 7 and the centering bushes 10, 10.

Figure 3:
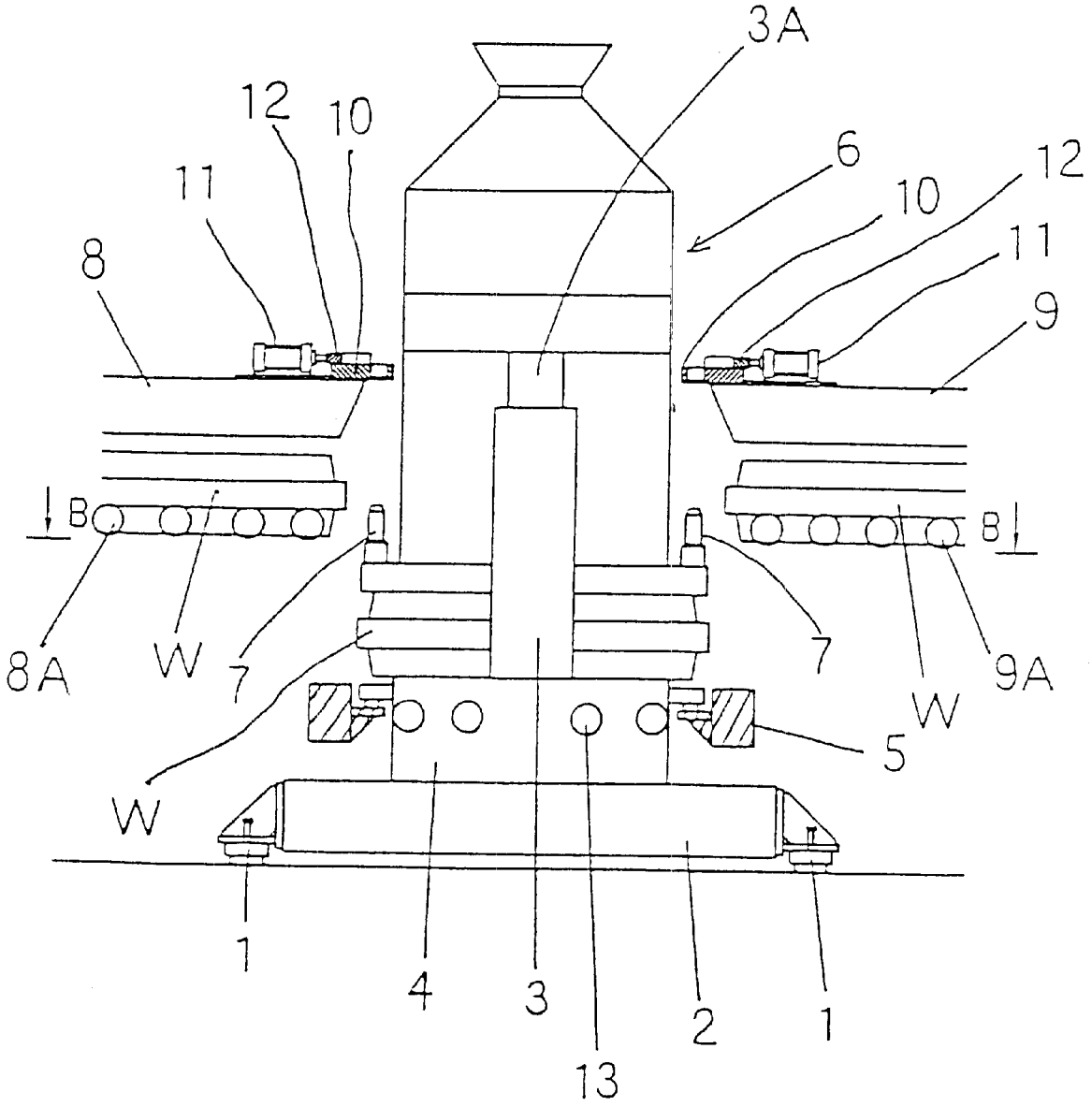
FIG. 3 is a schematic front view of the molding system during the molding operation. Part of the system is omitted.
Figure 4:
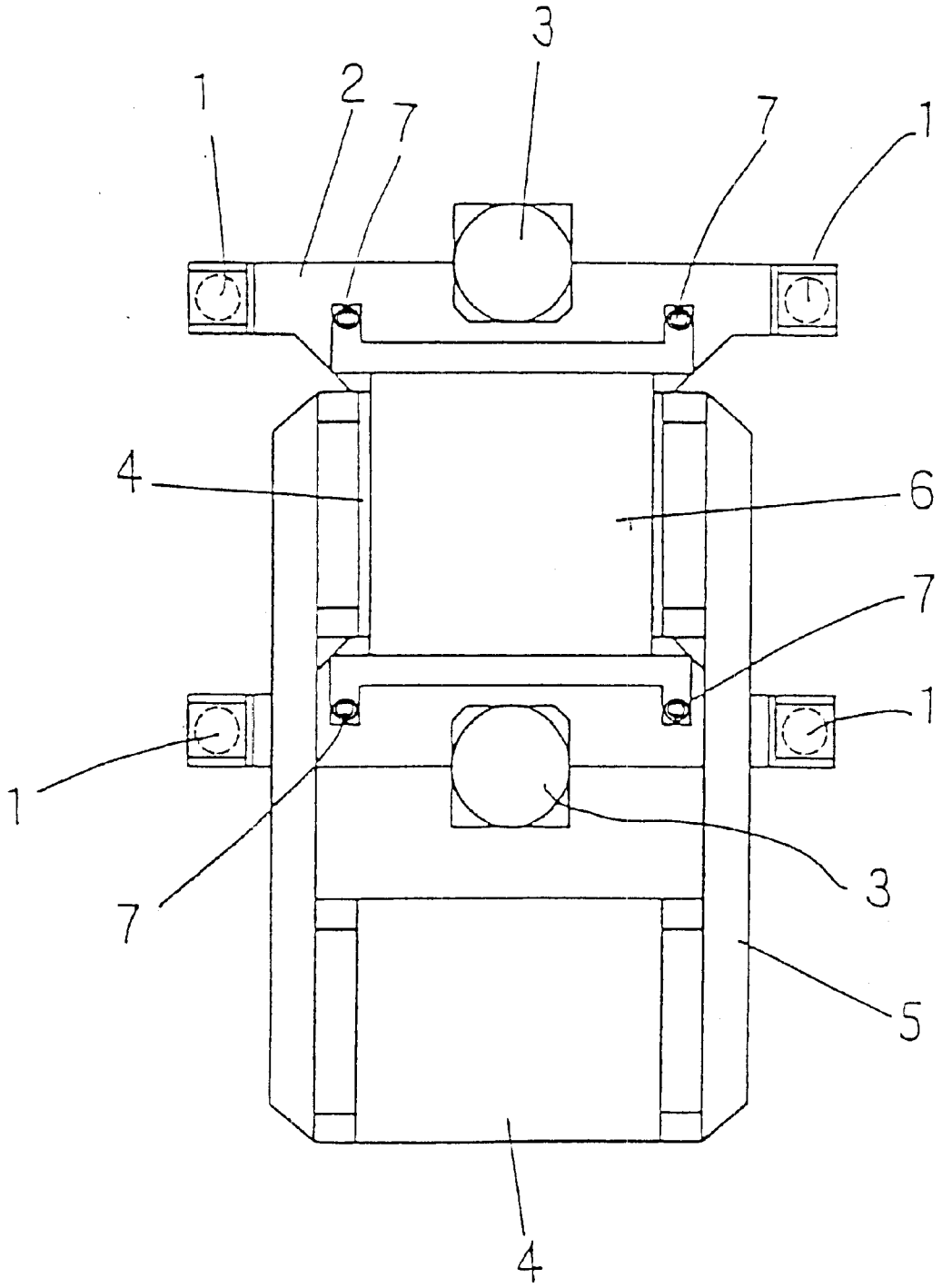
FIG. 4 is a sectional view along the line B—B in FIG. 3.

Then, the frame-setting cylinders 3, 3 retract to move down both the molding head 6 and the empty molding frame W, to set the molding frame W on the pattern carrier 4 on the turntable 5 (as in FIG. 3).

Then, the molding head 6 acts to carry out a molding operation, e.g., blowing-molding molding sand into the empty molding frame W or compression molding. Vibrations generated from the molding head during such a molding operation are absorbed and attenuated by the frame-setting cylinders 3, 3, the molding supports 2, and the vibration-insulating pads 1, 1. Thus, the nearby apparatuses are insulated from the vibrations.

Then, when the frame-setting cylinders 3, 3 extend to move up both the molding head 6 and the molded molding frame W to the highest point that the cylinders can reach, the centering pins 7, 7 are inserted into the centering bushes 10, 10.

Then, each molding frame is moved rightward by given distances so that a molded molding frame W is fed out from the roller 13 to the roller 9A, while an empty molding frame W is fed in from the roller 8A to the roller 13. As stated above, the lateral loads generated during these operations are received by the roller frames 8, 9, which are used to feed the molding frames in and out. During those operations the turntable 5 operates to exchange pattern carriers 4, 4 for the subsequent molding operation.

These operations are repeated.

During the maintenance of the molding system, safety is assured by first moving up the molding head 6 to its highest end, and then operating the cylinders 11, 11 to engage the safety stoppers 12, 12 with the centering pins 7, 7.

The embodiment discussed above uses the centering pins 7, 7, as the first centering means. These pins are located at both sides of the lower end of the molding head 6, and project upward. Also, it uses the bushes 10, 10, as the second centering means, which bushes are located on the roller frames 8, 9, which are used to feed molding frames in and out, to engage with the centering pins 7, 7. However, for the first and second centering means any construction may be used that can receive the lateral loads that are generated when the molding frames are fed in and fed out or the upper and lower pattern carriers are exchanged. For example, inlike the embodiment discussed above, receiving members such as the bushes may be located at both sides of the lower end of the molding head 6, and pins may be located on the roller frames 8, 9 to engage with the receiving members.

The molding system of this invention includes a molding support located on a plurality of vibration-insulating pads, a turntable to allow pattern carriers to be alternately fed in and fed out above the molding support, a molding head located above the turntable, which molding head moves up and down, two pairs of centering pins located on the molding head, roller frames for feeding in and out molding frames hanging rollers located at the outside of and near the highest end of the molding head, centering bushes located above the roller frames that are used to feed the molding frames in and out, which frames correspond to the two pairs of the centering pins, and rollers hung from the molding head. Thus, the lateral loads that are generated when the molding frames are fed out and in or when the pattern carriers for the upper and lower frames are exchanged can be received by the roller frames by means of the connection between the centering pins and the centering bushes. Also, the vibrations generated during the molding operations can be insulated from the nearby apparatuses, and absorbed and attenuated by the vibration-insulating pads, so that the area around a factory is prevented from being degraded and so that noise can be decreased.

Also, many effects can be generated by which the centering operations of the molding apparatuses and relevant apparatuses can be decreased, the cost of fixing those apparatuses can be decreased, vibrations transmitted to the base floor can be decreased, and the cost for making the base floor can be decreased.

What is claimed is:

1. A molding system for a sand mold with a frame, comprising:

a molding support located on a plurality of vibration-insulating pads, a turntable to allow pattern carriers to be alternately fed in and fed out above the molding support, a molding head having a lower end located above the turntable and supported by at least one pair of frame-setting cylinders for up and down movement between upper and lower positions, the molding head suspending rollers under the lower end thereof, first centering means located at both sides of the lower end of the molding head, roller frames located outside of the molding head at the upper position thereof for feeding in and out molding frames, each of the roller frames suspending rollers thereunder, and second centering means located above the roller frames for feeding in and out molding frames and cooperating with the first centering means to secure relative lateral positioning of the molding head and the roller frames when the molding head is in the upper position.

2. The molding system of claim 1 wherein one of the at least one pair of frame-setting cylinders also serves as a center shaft for rotation of the turntable.

3. The molding system of claim 1 wherein said first centering means comprises a projecting member located to project upward at both sides of the lower end of the molding head, and wherein said second centering means is located on the roller frames and comprises a receiving member having a hole through which the projecting member passes and engages when the molding head moves to the upper position.

4. The molding system of claim 3 wherein said projecting member comprises two pairs of centering pins and wherein the receiving member comprises centering bushes engaging with the centering pins.

5. The molding system of claim 1 wherein said first centering means comprises a receivable member located at both sides of the lower end of the molding head, and wherein said second centering means is located on the roller frames and comprises a receiving member that engages with the receivable member when the molding head moves upward.

6. The molding system of claim 1 wherein when the molding head moves upward, said first and second centering members are engaged with each other and then a molded molding frame is fed out from the rollers under the molding head to the rollers under one of the roller frames while an empty molding frame is fed onto the rollers under the molding head.

* * * * *